US006516981B2

(12) United States Patent
Perez et al.

(10) Patent No.: US 6,516,981 B2
(45) Date of Patent: Feb. 11, 2003

(54) TACTICAL MEDICAL VEST AND METHOD OF PROVIDING EMERGENCY MEDICAL CARE

(76) Inventors: Esther C. Perez, 1901 Aurelius Rd., Holt, MI (US) 48842; Michael J. Perez, 1901 Aurelius Rd., Holt, MI (US) 48842

( * ) Notice: Subject to any disclaimer, the term of this patent is extended or adjusted under 35 U.S.C. 154(b) by 0 days.

(21) Appl. No.: 09/935,518

(22) Filed: Aug. 23, 2001

(65) Prior Publication Data

US 2001/0052532 A1 Dec. 20, 2001

Related U.S. Application Data

(62) Division of application No. 09/289,994, filed on Apr. 12, 1999, now Pat. No. 6,279,580, which is a division of application No. 08/821,394, filed on Mar. 20, 1997, now Pat. No. 5,893,370.

(51) Int. Cl.[7] ..... A45F 5/02

(52) U.S. Cl. ..... 224/148.6; 2/94; 2/102; 2/251; 2/253; 206/803

(58) Field of Search ..... 206/581, 803; 2/94, 102, 251, 253; 224/148.6, 148.7

(56) References Cited

U.S. PATENT DOCUMENTS

| | | | | | |
|---|---|---|---|---|---|
| 2,120,234 | A | * | 6/1938 | Armstrong | 206/338 |
| 2,324,194 | A | * | 7/1943 | Campiglia | 206/570 |
| 2,409,354 | A | | 10/1946 | Grunwell | |
| 2,760,699 | A | | 8/1956 | Rivers-MacPherson | |
| 3,547,322 | A | * | 12/1970 | Dawson | 224/148.2 |
| 4,041,549 | A | * | 8/1977 | Atkinson | 139/391 |
| 4,087,864 | A | | 5/1978 | LaBove et al. | |
| 4,106,121 | A | | 8/1978 | Belson | |
| 4,169,550 | A | | 10/1979 | Williams | |
| 4,438,763 | A | * | 3/1984 | Zablen | 128/845 |
| 4,513,866 | A | * | 4/1985 | Thomas | 190/110 |
| 4,609,084 | A | | 9/1986 | Thomas | |
| 4,637,075 | A | | 1/1987 | Ingrisano et al. | |
| 4,796,790 | A | | 1/1989 | Hamilton | |
| 5,072,456 | A | | 12/1991 | Elin | |
| 5,111,981 | A | | 5/1992 | Allen | |
| 5,265,782 | A | * | 11/1993 | McNamara | 2/108 |
| 5,361,412 | A | * | 11/1994 | Perry | 2/102 |
| 5,370,113 | A | | 12/1994 | Parsons | |
| 5,544,363 | A | * | 8/1996 | McCue et al. | 2/102 |
| 5,676,294 | A | * | 10/1997 | Eklund et al. | 128/DIG. 6 |
| 5,799,846 | A | * | 9/1998 | Pfleger | 224/148.7 |
| 5,893,370 | A | * | 4/1999 | Perez et al. | 2/94 |
| 6,279,580 | B1 | * | 8/2001 | Perez et al. | 128/897 |

* cited by examiner

*Primary Examiner*—Stephen P. Garbe
(74) *Attorney, Agent, or Firm*—Mary M. Moyne; Ian C. McLeod

(57) ABSTRACT

A medical vest (10) and a method of using the vest to provide emergency medical care to a patient (102), are described. The vest includes an IV container (28) and a medical supply container (58) which are mounted on mounting pads (22, 24 or 26) on the front (12) or back (14) of the vest. The containers are also connected to the shoulders (16) of the vest by shoulder straps (27). The IV container is configured to carry an IV bag (150) as well as all the medical supplies necessary to provide an IV to a patient. The container is constructed so as to remain in the open position to allow the user to use both hands to tend to the patient. A clip strap (46) with a self-closing hook (48) is provided with the container to allow the container to be hooked near a patient for transport with the patient. The medical supply container has a variety of uses and can be provided with inserts with loops (69) for holding airway equipment or inserts without loops to hold additional emergency medical supplies.

6 Claims, 5 Drawing Sheets

48
46
49
50
52
28
35
32
30
40B
40A
40
42B
36
42A
42
42C
38
39
33
44
34A
34C
34
34B

TACTICAL MEDICAL VEST AND METHOD OF PROVIDING EMERGENCY MEDICAL CARE

This application is a divisional of application Ser. No. 09/289/994 filed on Apr. 12, 1999, now U.S. Pat. No. 6,279,580, which is a division of Ser. No. 08/821,394 filed Mar. 20, 1997 now U.S. Pat. No. 5,893,370.

BACKGROUND OF THE INVENTION (1) Field of the Invention

The present invention relates to an article of clothing for carrying medical supplies on a person. In particular, the present invention relates to a vest having removable containers which hold medical supplies and which allow the user to carry the supplies hands free.

(2) Description of the Related Art

The related art has shown various types of vests for carrying medical and/or tactical supplies. Illustrative are U.S. Pat. Nos. 4,087,864 to LaBove et al; 4,106,121 to Belson; 4,637,075 to Ingrisano et al; 5,072,456 to Elin and 5,370,113 to Parsons.

In particular, Belson describes a tactical load bearing vest having several supply pouches attached to the front of the vest. The specific pouches are a hand gun cartridge pouch, a shotgun shell pouch, a rifle cartridge clip pouch, a first aid pouch, a carbine clip pouch, etc. Each pouch has a rectangular base of heavy fabric and a fabric pocket having one or more ends extended to fold over to cover the open end to prevent loss of the supplies. Some pouches have webbing stitched onto the base to form loops that hold ammunition rounds. Each of the pouches is mounted on the vest by both Velcro® and snap fasteners. The vest also includes a radio carrying pouch, a canteen pouch and a side holster hanger strip.

Ingrisano et al describes an emergency medical services (EMS) vest for carrying EMS equipment and supplies. The vest has a plurality of outside pockets of varying sizes to hold different equipment and supplies. Loop holders are also provided to hold airways. The pockets are not removable.

In addition, Parsons describes a self contained breathing apparatus where the storage case is converted into a vest to be worn by the user. The vest allows the user to carry the air storage cylinder on his back while using the apparatus.

LaBove et al describes a vest for patients undergoing intravenous hyperalimentation. The vest allows the patient to remain ambulatory while receiving the treatment. The vest has a medication pocket which receives and holds the bag of medication. The pocket consists of a flap mounted along one edge of the vest and having a set of fasteners along the opposite edge. The fasteners engage a matching set of fasteners on the vest. The flap forms a U-shaped sleeve extending outwardly from the front panel. The bag preferably has a hang loop at one end and at least one outlet at the other end. An attaching tab having a snap ring is mounted on the vest above the medication pocket to retain the pouch in the proper position in the vest. A support strap extends across the bottom of the pocket to hold the pouch within the sleeve formed by the flap. The support strap has an opening to allow an outlet of the pouch to pass therethrough for connection with a tube which connects the pouch with the pump. The vest also has a pump pocket which holds the pump which transfers medication from the pouch to the patient and a power supply pocket. The medication pocket which holds the pouch is not removable. Furthermore, the pocket is not constructed to hold any other medical supplies.

Also of interest are U.S. Pat. Nos. 4,513,866 to Thomas which describes an emergency medical pack for storing and transporting emergency medical supplies and 4,609,084 to Thomas which shows a similar pack used for storing and transporting equipment for travel. Further, U.S. Pat. Nos. 4,169,550 to Williams and 4,796,790 to Hamilton show devices for carrying medical supplies.

Only of minimal interest are U.S. Pat. Nos. 2,409,354 to Grunwell; 2,760,699 to Rivers-Macpherson and 5,111,981 to Allen which show different devices for carrying objects on a person.

There remains the need for a vest which can be worn on the upper body of a user and which has removable containers for carrying medical supplies where the containers can be pivotably moved from the front to the back of the vest without removing the container from the vest and where one of the containers is an adaptor to hold an intravenous (IV) bag to allow the user to have easy access to the IV and hands-free use of the IV once the IV has been provided to the patient.

Objects

It is therefore an object of the present invention to provide a medical tactical vest which allows a user to carry medical supplies without use of hands. Further, it is an object of the present invention to provide a medical tactical vest which has containers which store various medical supplies and which are easily removed from the vest. Still further, it is an object of the present invention to provide a medical tactical vest which has containers which store medical supplies where the containers can be easily reached and opened while connected to the vest. Further still, it is an object of the present invention to provide a medical tactical vest which has a container which holds an IV bag and lines and which is removable from the vest for transportation with the patient. Further, it is an object of the present invention to provide a medical tactical vest which has containers for holding medical supplies which are connected to the vest by Velcro® and by straps so that the containers can be moved from the back portion of the vest to the front portion of the vest when needed. It is further an object of the present invention to provide a container for mounting on a tactical vest which holds an IV bag, IV catheter and IV lines and which will remain in the open position to allow hands-free use.

These and other objects will become increasingly apparent by reference to the following drawings and the description.

DETAILED DESCRIPTION OF THE PREFERRED EMBODIMENT

Figures 1, 2:
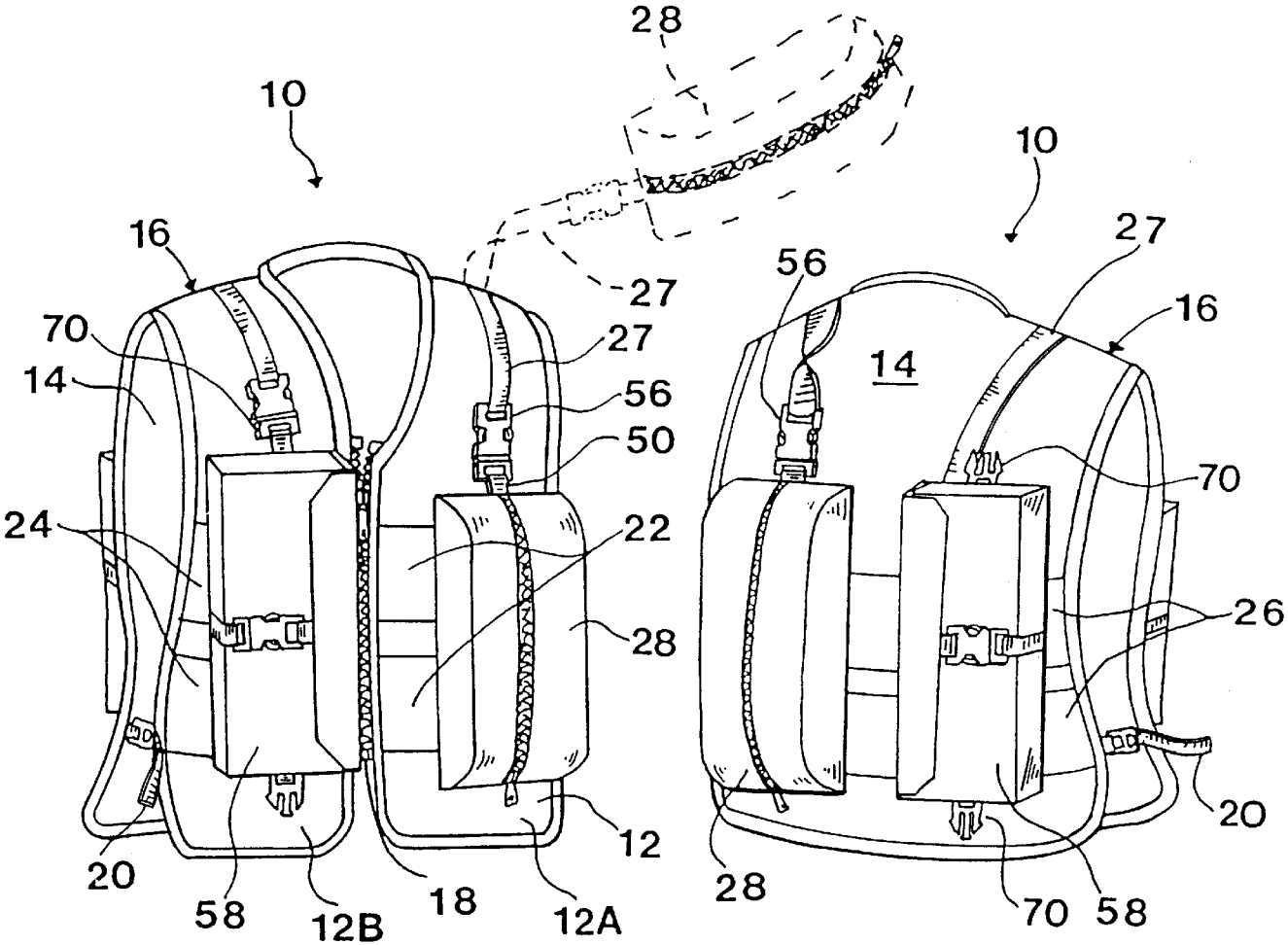
FIG. 1 is a front perspective view of the tactical medical vest 10 showing the IV container 28 and the medical supply container 58.
FIG. 2 is a rear perspective view of the tactical medical vest 10 showing the containers 28 and 58 mounted on the back 14 of the vest 10.

The present invention relates to an article of clothing for wearing on an upper body of a user for holding emergency medical supplies, which comprises: a front section and a back section, each section having a top and a bottom with an inside surface and an outside surface extending therebetween and connected together at the top, wherein the front section has a first portion and a second portion; a means for removably connecting the first portion and the second portion of the front section together; at least one container removably mounted on one of the sections of the article of clothing on the outside surface, the containers each having: a connection means for releasably and movably connecting the container to the article so that the container is able to be released from the article and is able to be moved away from the article while remaining connected to the article; a fastening means for fixably and releasably mounting the container on the article wherein the containers are configured to hold emergency medical supplies.

Further, the present invention relates to a container for mounting on an article of clothing for wearing on an upper body of a user for holding emergency medical supplies, the article of clothing including a front section and a back section, the container which comprises: a first, second and third section, each section having a top and a bottom with a first and second side extending therebetween forming an inside surface and an outside surface, the sections are connected together so that the first side of the second section is connected to the second side of the first section, and the first side of the third section is connected to the second side of the second section so that the top of the sections are adjacent, wherein the container is removably mounted on the article of clothing so that the outside surface of the third section of the container is adjacent the front section of the article of clothing and wherein the medical supplies are removably mounted on the inside surfaces of the first, second and third sections of the container; a fastener having a first half and an opposite and engaging second half, each half having a first end and a second end with the first end of the first half mounted on the top of the second section and the second end of the first half mounted on the bottom of the second section so that the first half of the fastener extends along the tops of the second and first sections and along the first side of the first section to the bottoms of the first and second sections and with the first end of the second half of the fastener mounted on the top of the second section and the second end of the second half mounted on the bottom of the second section so that the second half of the fastener extends along the tops of the second and third sections and down along the second side of the third section to the bottoms of the third and second sections wherein when the first half and the second half of the fastener are connected together, the inside surfaces of the first, second and third sections are inside the container, and wherein when the first and second halves of the fastener are unfastened, the first and second sections are configured to be turned so that the inside surfaces of the first, second and third sections are visible.

Still further, the present invention relates to a method for hands-free carrying and use of emergency medical supplies by medical personnel and to administer medical aid to a patient, which comprises: providing an article of clothing for wearing on an upper body of a user for holding emergency medical supplies, which comprises: a front section and a back section, each section having a top and a bottom with an inside surface and an outside surface extending therebetween and connected together at the top, wherein the front section has a first portion and a second portion; a means for removably connecting the first portion and the second portion of the front section together; at least one container removably mounted on one of the sections of the article of clothing on the outside surface, the containers each having: a connection means for releasably and movably connecting the container to the article so that the container is able to be released from the article and is able to be moved away from the article while remaining connected to the article; a fastening means for fixably and releasably mounting the container on the article wherein the containers are configured to hold emergency medical supplies; positioning the article of clothing on the upper body and fastening the fastener; moving adjacent to the patient to be treated; opening the containers on the article of clothing; removing the necessary emergency medical supplies; and administering medical aid to the patient.

Further still, the present invention relates to a method for providing an intravenous solution to a patient at an emergency site, which comprises: a container for mounting on an article of clothing for wearing on an upper body of a user for holding emergency medical supplies, the article of clothing including a front section and a back section and configured to be worn by a user, the container which comprises: a first, second and third section, each section having a top and a bottom with a first and second side extending therebetween forming an inside surface and an outside surface, the sections are connected together so that the first side of the second section is connected to the second side of the first section, and the first side of the third section is connected to the second side of the second section so that the top of the sections are adjacent, wherein the container is removably mounted on the article of clothing so that the outside surface of the third section of the container is adjacent the front section of the article of clothing and wherein the medical supplies are removably mounted on the inside surfaces of the first, second and third sections of the container; a fastener having a first half and an opposite and engaging second half, each half having a first end and a second end with the first end of the first half mounted on the top of the second section and the second end of the first half mounted on the bottom of the second section so that the first half of the fastener extends along the tops of the second and first sections and along the first side of the first section to the bottoms of the first and second sections and with the first end of the second half of the fastener mounted on the top of the second section and the second end of the second half mounted on the bottom of the second section so that the second half of the fastener extends along the tops of the second and third sections and down along the second side of the third section to the bottoms of the third and second section wherein when the first half and the second half of the fastener are connected together, the inside surfaces of the first, second and third sections are inside the container, wherein when the first and second halves of the fastener are unfastened, the first and second sections are configured to be turned so that the inside surfaces of the first, second and third sections are visible and wherein the container holds an intravenous bag and intravenous lines; positioning the article of clothing on the upper body and fastening the fastener; moving adjacent to a patient to be treated; unfastening the fastener of the container and folding the first and third sections of the container outward so that the container remains open with the intravenous lines exposed; inserting the intravenous catheter into the patient; and folding the first and third sections inward and closing the fastener of the container so that the intravenous bag is covered and the intravenous line extends from the container through an open portion of the fastener wherein the user is able to tend to the patient without having to hold the intravenous bag.

The article of clothing is preferably a vest having a zipper front closure. The containers are preferably mounted on the front or back of the vest by a hook and loop fastener such as Velcro®. The containers are also preferably pivotably connected to the shoulders of the vest by straps which allow the containers to be flipped over the shoulder of the vest and rotated 180° to be mounted on the back or front of the vest. There are preferably two containers on the vest. One of the containers holds an IV bag, IV catheter, IV lines and other medical supplies needed to start an IV. The container is constructed of a flexible material and is closed by a zipper. The container remains in the open position once the sides of the container are folded backwards to expose the inside of the bag. A hook strap is also provided in the IV bag to allow the bag to be removed from the vest and transported with the patient. The medical supply container mounts sideways on the vest. The medical supply container has inserts which are specifically designed to hold certain medical supplies.

Figure 6:
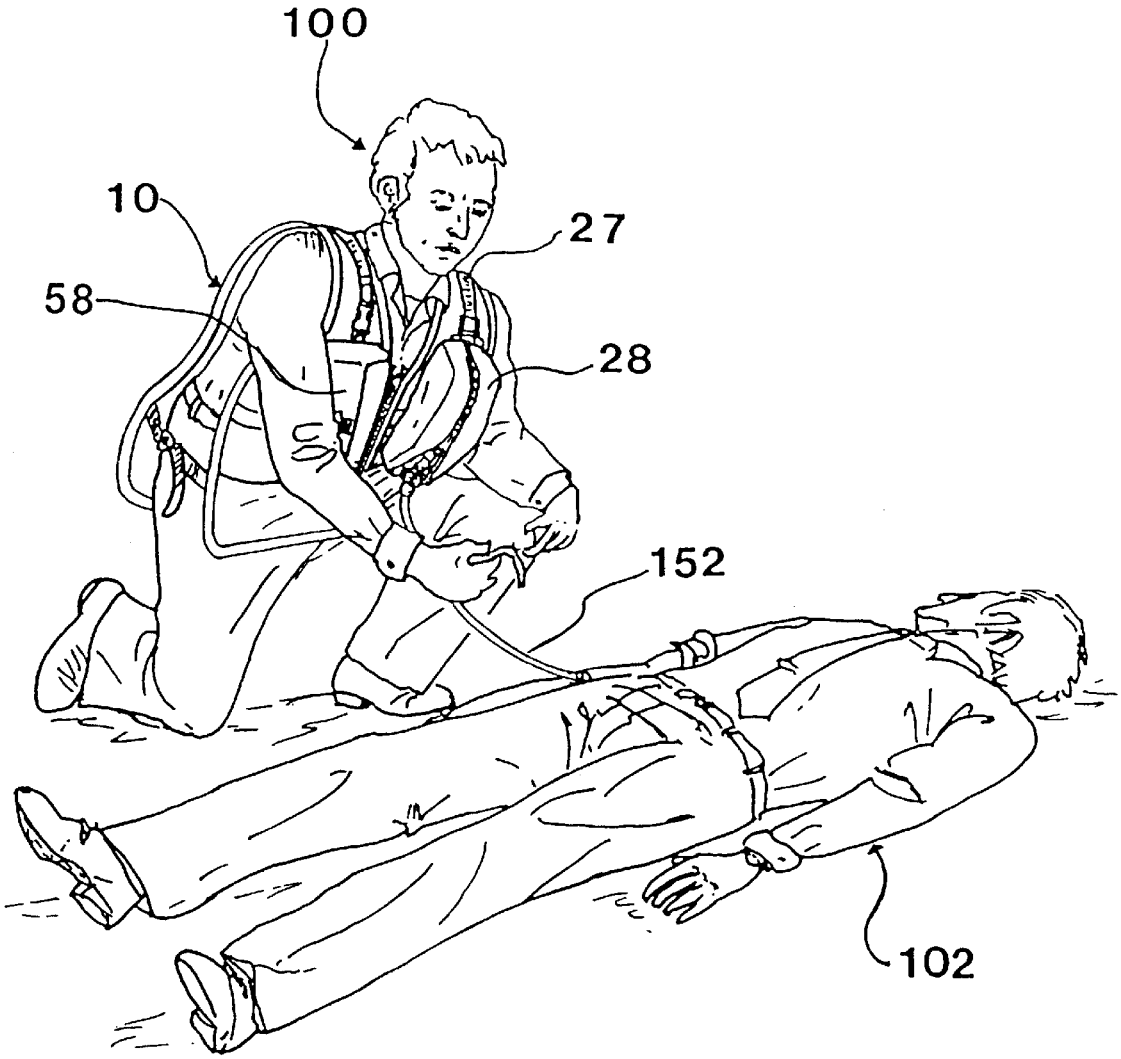
FIG. 6 is a perspective view of the tactical medical vest 10 mounted on a user 100 with the IV container 28 in the closed position and the IV line 152 extending to a patient 102.

FIGS. 1, 2 and 6 show the tactical medical vest 10 of the present invention. The vest 10 is intended to enable emergency medical personnel 100 to easily carry medical supplies into a tactical situation and to provide medical attention to a patient 102. The vest 10 preferably includes an intravenous IV container 28 and a medical supply container 58.

The vest 10 has a back 14 and a front 12 which are connected together at the top to form the shoulders 16 of the vest 10. The front 12 of the vest 10 has a right side 12A and a left side 12B when viewed from the front which are connected together by a zipper 18 (FIG. 1). However, any type of fastening means can be used. The front 12 and back 14 of the vest 10 are preferably connected together at each side by an adjustment strap 20 which allows the size of the vest 10 to be adjusted for a specific user 100. The vest 10 is preferably constructed of a lightweight, nylon mesh or other fabric or material which allows the vest 10 to be lightweight, yet durable. Preferably, the vest 10 covers the entire torso of the user 100 and extends beyond the waist of the user 100. Although use of a lightweight vest is preferred, the container 28 and 58 could also be mounted on other articles of clothing such as a coat or a shirt.

The vest 10 is provided with mounting pads 22, 24 or 26 on both the right and left sides 12A and 12B of the front 12 of the vest 10 and across the back 14. Preferably, the mounting pads 22, 24 or 26 are positioned at approximately the same point on the front 12 and back 14 of the vest 10. In the preferred embodiment, the mounting pads 22, 24 or 26 consist of two spaced apart pads having a width of 4.0 inches (10.2 cm). However, the size of the pads can be varied provided the pads securely hold the containers 28 and 58 on the vest 10. Preferably, the mounting pads 22, 24 or 26 are constructed of Velcro®. However, other types of releasable fasteners could also be used to mount the containers 28 and 58.

The vest 10 also has a pair of shoulder straps 27 which are mounted at one end on the back 14 of the vest 10 adjacent the mounting pads 26 and extend upward over the shoulders 16 of the vest 10. The straps 27 are preferably attached to the back 14 of the vest 10 between the mounting pads 26 and the shoulders 16. The shoulder straps 27 extend down the front 12 of the vest 10 toward the mounting pads 22 and 24 on the front 12 of the vest 10. The other ends of the shoulder straps 27 preferably have fasteners 56 such as the female connector of a fastening clip, which allow for securely mounting the containers 28 and 58 on the vest 10.

Figure 3:
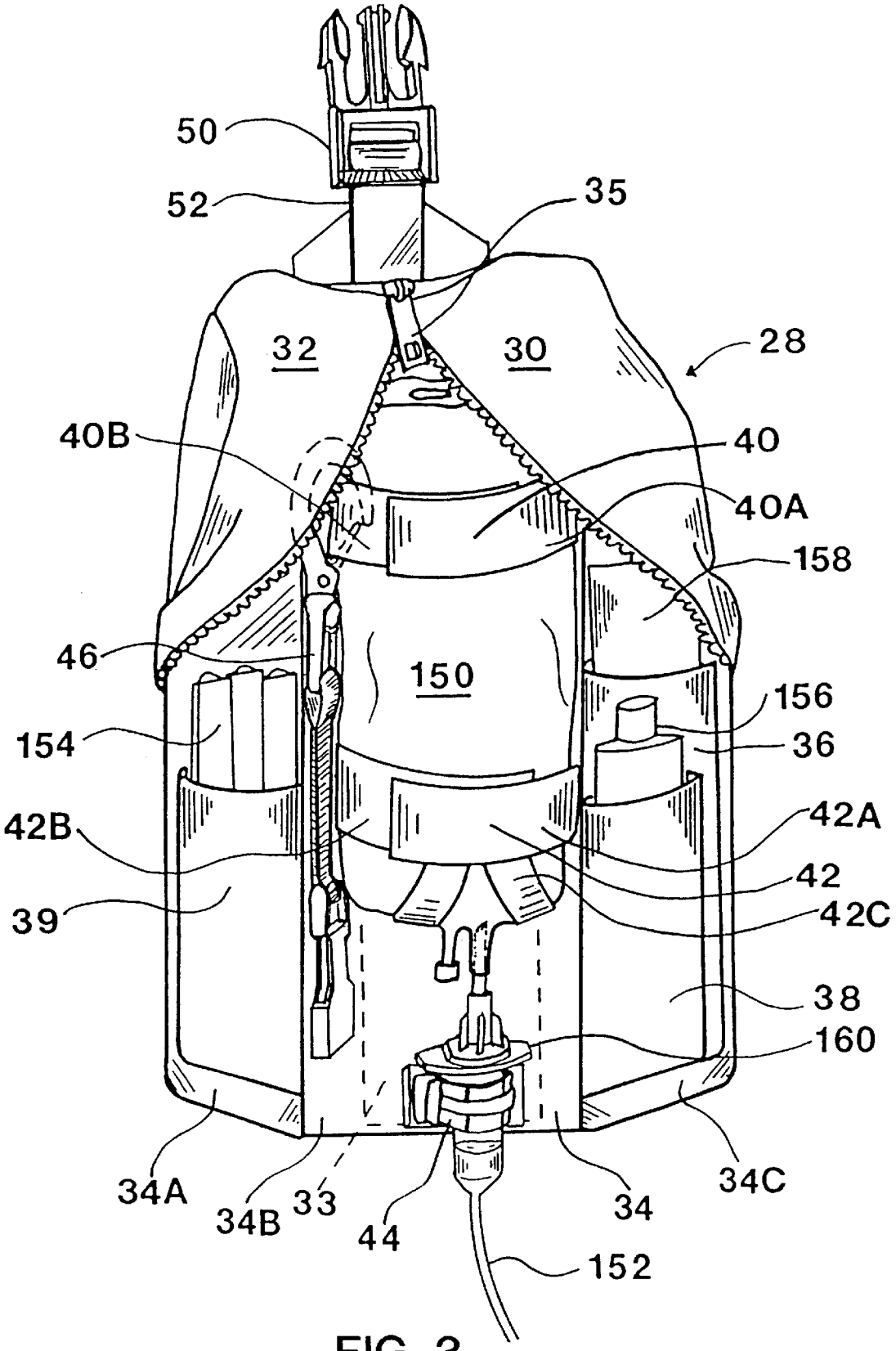
FIG. 3 is a front view of the IV container 28 in the open position showing the IV bag 150, the IV catheter 154, IV line 152 and the antiseptic 156.
Figure 4:
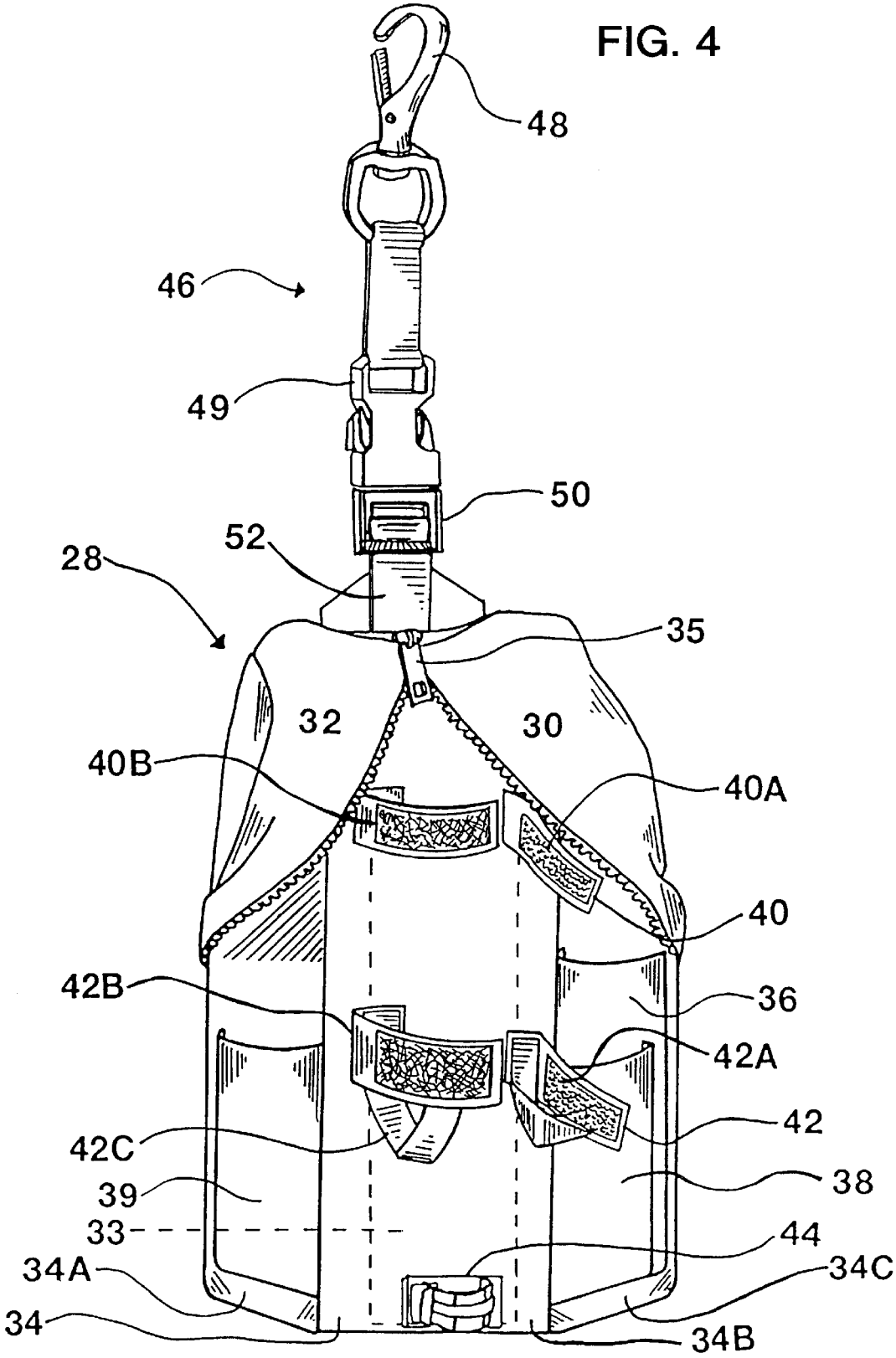
FIG. 4 is a front view of the empty IV container 28 in the open position showing the upper and lower straps 40 and 42.

The IV container or pouch 28 as shown in FIGS. 3 and 4 is preferably configured to hold an IV bag 150, IV catheters 154, tape (not shown), a tourniquet (not shown), antiseptics 156, IV site dressings 158 and gloves (not shown). The IV container 28 is preferably constructed of a right portion 30 and a left portion 32 with a center portion 34 spaced therebetween. The right and left portions 30 and 32 are preferably similar and have an essentially rectangular shape. The sides of the right and left portions 30 and 32 of the container 28, opposite the center portion 34, are provided with a releasable fastener 48. In the preferred embodiment, the releasable fastener 48 is a zipper 35. However, any well known easily released fastener could be used. Preferably, the zipper 35 is positioned such that when the zipper 35 is fully closed, the tag of the zipper 35 is located at the bottom of the container 28 adjacent the bottom of the bag 150. The right and left portions 30 and 32 of the container 28 are preferably longer than the center portion 34 of the container 28 so that the ends of the right and left portions 30 and 32 curve around and are connected to the ends of the center portion 34. The added length of the right and left portions 30 and 32 enables the container 28 to have extra room inside to accommodate the medical supplies stored in the pockets 36, 38 and 39 on the inner surface of the left and right sections 34A and 34C of the center portion 34 of the container 28 (to be discussed in detail hereinafter). The right and left portions 30 and 32 of the container 28 are preferably constructed of a flexible, lightweight fabric which is durable such as nylon.

The center portion 34 also has an essentially rectangular shape. In the preferred embodiment, the center portion 34 is divided into three sections, the left section 34A, the middle section 34B and the right section 34C. The center portion 34 of the container 28 is preferably constructed of a single piece of flexible fabric such as nylon. The middle section 34B of the center portion 34 is preferably provided with an added layer of material to provide a stiffness for mounting the IV bag 150. Alternatively, the center portion 34 is constructed of three separate pieces of material and the middle section 34B of the center portion 34 is preferably constructed of a more rigid material. The stiffness of the middle section 34B also allows for eaiser mounting of the container 28 on the vest 10 and enables the container 28 to be folded open and to remain in the open position. The outer surface of the middle section 34B is provided with a fastener 33 to allow the container 28 to be mounted on the mounting pads 22, 24 or 26 of the vest 10. The fastener 33 preferably extends the entire length of the center portion 34 but only covers a portion of width of the middle section 34B of the center portion 34. The fastener 33 is preferably Velcro®. The inner surface of each of the right and left sections 34A and 34C of the center portion 34 is provided with pockets 36, 38 and 39 to hold different types of medical supplies. In the preferred embodiment, one section 34A or 34C has a large pocket 36 with a smaller pocket 38 attached on top of the large pocket 36. The larger pocket 36 preferably holds IV dressings 158 and the smaller pocket 38 preferably holds antiseptic 156 or hand cleaning gel (FIG. 3). The other section 34C or 34A is preferably provided with a single pocket 39 which holds IV dressings 158, gloves or IV catheter placement units 154. The inner surface of the middle section 34B is provided with upper and lower straps 40 and 42 for positioning and holding the IV bag 150 (FIGS. 3 and 4) in the container 28. The upper strap 40 preferably has a right and left side strap 40A and 40B which each have one side of a fastener such as Velcro®. The side straps 40A and 40B connect together to securely hold the top of the IV bag 150 against the inner surface of the middle section 34B of the center portion 34 of the bag 150. The lower strap 42 preferably also has a right strap 42A and a left strap 42B. The straps 42A and 42B are also provided with angled support straps 42C which extend from the inner surface 34B of the center section 34 and angle to the center of the right and left straps 42A and 42B (FIG. 4). The lower strap 42 with the angled support straps 42C provides lower support for the IV bag 150. The angled support straps 42C prevent the IV bag 150 from slipping downward out of the upper and lower straps 40 and 42. The positioning of the angled straps 42C provides an opening which allows the outlet of the IV bag 150 and the IV lines 152 to extend downward (FIG. 3). The size of the straps 40 and 42 are preferably adjustable to accommodate different sizes of IV bags. Furthermore, preferably the straps 40 and 42 are also able to accommodate a pressure infuser bag (not shown). The inner surface of the middle section 34B is also preferably provided with a clip 44 which secures the IV drip chamber 160 in place in the container 28. Preferably, the clip 44 is positioned directly below the opening provided by the angled support straps 42C (FIG. 3). The clip 44 can be attached to the center portion 34 by a number of well known means such as rivets or sewing.

In the preferred embodiment, a fastener 50 is mounted by a strap 52 on the top of the container 28. The fastener 50 is the male connector of a fastening clip such as to engageably mate with the fastener 56 on one of the shoulder straps 27 of the vest 10. A clip strap 46 is also provided in the inside of the IV container 28 (FIG. 3). In the preferred embodiment, the clip strap 46 has a self-closing hook 48 at one end and one half of a fastener 49 at the other end. The hook 48 is preferably rotatably mounted on the strap 46. The fastener 49 will engageably mate with the half of the fastener 50 on the top end of the container 28. The clip strap 46 is secured in the inside of the container 28 by clipping the self-closing hook 48 onto one side of the upper strap 40 so that the clip strap 46 extends downward along the side of the bag 150.

Figure 5:
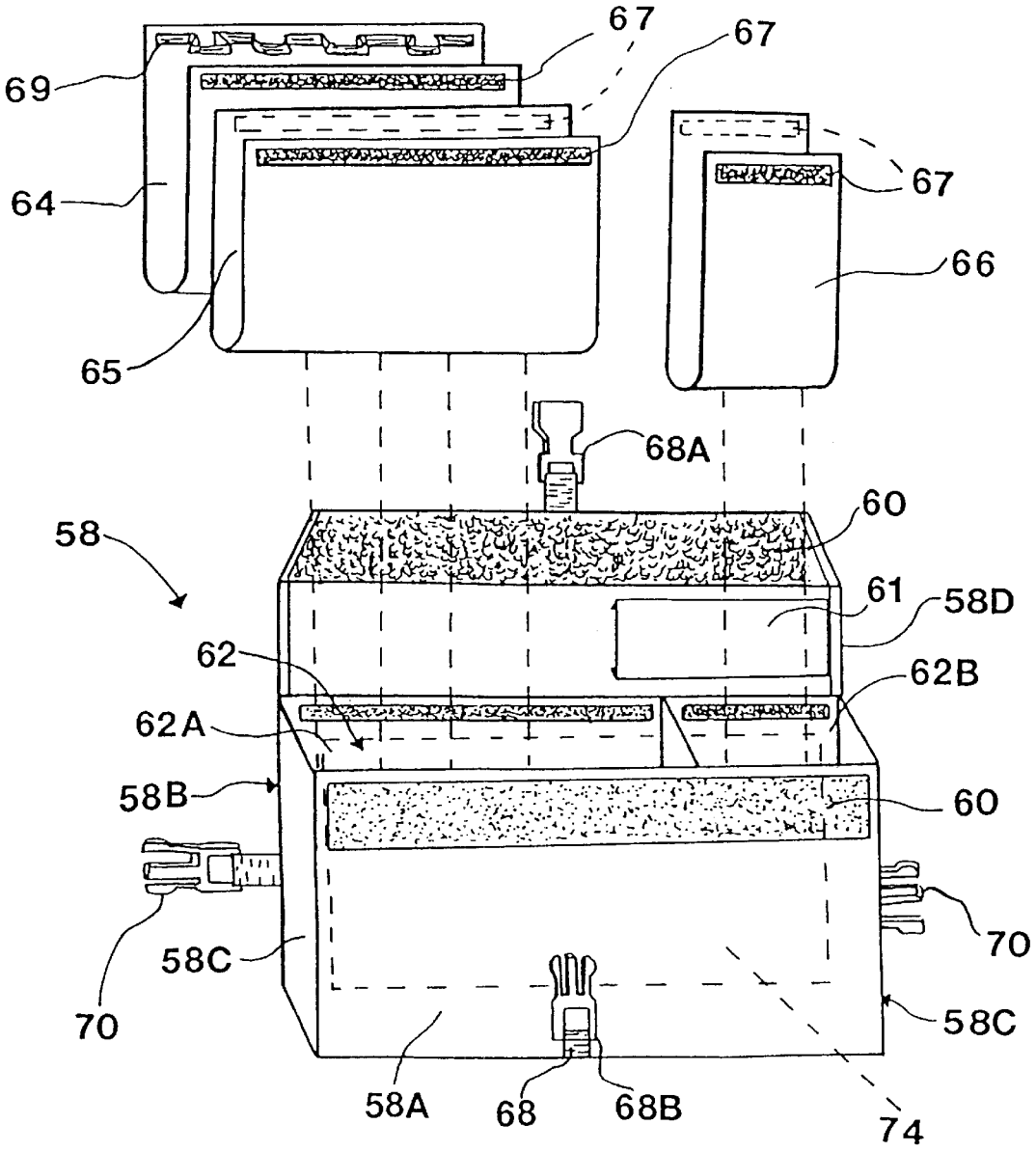
FIG. 5 is an exploded front view of the medical supply bag 58 showing the inserts 64, 65 and 66.

The medical supply container or pouch 58 is preferably mounted on the front 12 of the vest 10 on the side opposite the IV bag container 150 (FIG. 1). In the preferred embodiment, the container 58 is configured to hold bandages, gauze, scissors, tape, vaseline, dressings 158 and other basic life support medical supplies. The container 58 is preferably constructed of a flexible, lightweight, durable material such as nylon. The medical supply container 58 preferably has a front wall 58A, a back wall 58B and two sidewalls 58C (FIG. 5). The back wall 58B preferably is connected at one end to the bottom edge of the front wall 58A and extends around and upward to form the bottom and back of the container 58. The sidewalls 58C preferably extend between the front wall 58A and the back wall 58B from the bottom of the container 58 to the open top of the container 58. The back wall 58B, front wall 58A and sidewall 58C preferably form an inner chamber 62 which has an essentially rectangular shape (FIG. 5). In the preferred embodiment, the inner chamber 62 is divided into two sections 62A and 62B with one section 62A being about twice the size of the other section 62B. A pair of inserts 64 and 65 are mounted in the larger section 62A and a single insert 66 is mounted in the smaller section 62B of the container 58. The inserts 64, 65 and 66 are preferably constructed of a piece of rectangular, flexible material, such as plastic canvas which is shaped into a U-shape. The outer surface of the inserts 64, 65 and 66 preferably have fasteners 67 such as Velcro® to mount the inserts 66, 65 and 64 in the sections 62A and 62B of the inner chamber 62 of the container 58. The inserts 64, 65 and 66 allow the medical supplies to be quickly inserted and removed from the inner chamber 62 of the container 58. The inserts 64, 65 and 66 also add rigidity to the container 58. In addition, the inserts 64, 65 and 66 can be made of a lightweight, stiff or rigid material such as aluminum which would allow the container 58 to maintain its form and would prevent damage to the medical supplies in the container 58. The inserts 64, 65 and 66 also act as liners to protect the inner chamber 62 of the container 58. The first insert 64 for the larger section 62A of the inner chamber 62 has different mounting means such as loops 69, straps, hooks etc. on the inner surface, depending upon the intended use of the larger section 62A. In the preferred embodiment, the first insert 64 has loops 69 along one wall for holding airways (not shown) of various sizes (FIG. 5). The loops 69 can also be used to hold syringes, oropharyngeal airways, advanced airway medical supplies, airway support equipment, bite blocks, lubrication gel, oral glucose gel tubes and endotracheal tubes. The second insert 65 preferably allows for placing bandages and other medical supplies in the container 58. Preferably, the insert 66 for the smaller section 62B is mainly used to provide rigidity to the container 58.

In the preferred embodiment, the back wall 58B extends upward beyond the sides of the container 58 to form a flap 58D which is folded over the open top of the container 58. The inner surface of the flap 58D preferably has one half of a fastener 60 which engages a second half of the fastener 62 on the outside surface of the front wall 58A of the container 58. The fasteners 60 and 62 are preferably Velcro®, although, any well known releasable fasteners such as a snap could be used. The flap 58D of the container 58 also has a one half of closure fastener 68A connected to the outside surface. The one half of closure fastener 68A engages a second half of the closure fastener 68B connected on the seam of the front and back at the bottom of the container 58. The complete closure fastener 68 acts to help keep the flap 58D of the container 58 in the closed position. A pocket 61 is provided on the inner surface of the flap 58D preferably above smaller section 62B of the inner chamber 62. The pocket 61 allows for mounting a scalpel (not shown) or a penlight (not shown) in the container 58. The side walls 58C of the container 58 are preferably each provided with a fastener 70. The fasteners 70 are preferably mounted by a strap on the back wall 58B of the container 58. The fasteners 70 are preferably mounted such as to be centered between the top and bottom of the container 58. The back wall 58B of the container 58 is preferably provided with a fastener 74 on the outside surface which engages the mounting pads 22, 24 or 26 on the front 12 or back 14 of the vest 10. The medical supply container 58 is mounted on the vest 10 so that the one of the fasteners 70 on the sidewall 58C of the container 58 is connected to the fastener 56 on the shoulder strap 27 of the vest 10. Consequently, the container 58 is connected to the vest 10 such that the top and bottom of the container 58 are essentially parallel to the longitudinal axis of the vest 10.

In Use

The vest 10 is preferably used by medical personnel 100 to provide on site emergency medical assistance to a patient 102 during an emergency situation. The vest 10 allows the user 100 to easily, quickly and safely carry the necessary medical supplies to the patient 102 without endangering his life or the life of the patient 102. Prior to entering the emergency situation, the user 100 preferably fills the containers 28 and 58 with the necessary medical supplies. The user 100 then attaches the containers 28 and 58 to the shoulder straps 27 of the vest 10. The containers 28 and 58 are then securely fastened to the mounting pads 22, 24 or 26 on either the front 12 or back 14 of the vest 10 depending upon the particular situation (FIGS. 1 and 2). In the preferred embodiment, if the user 100 needs to crawl and remain close to the ground to reach the patient 102, then preferably, the containers 28 and 58 would be mounted on the back 14 of the vest 10 (FIG. 2). The flexible shoulder straps 27 enable the containers 28 and 58 to be flipped over the shoulders 16 of the vest 10 and rotated 180° so that the fasteners 33 or 74 on the containers 28 and 58 can engage the mounting pads 22, 24 or 26 on the front 12 or back 14 of the vest 10 (FIG. 1). The fastening of the shoulder straps 27 completely from the mounting pads 26 on the back 14 of the vest 10 to the shoulders 16 allows for better distribution of the weight of the containers 28 and 58 on the vest 10 when not connected to the mounting pads 22 or 24 on the vest 10. The mounting pads 22, 24 or 26 on both the front 12 and the back 14 of the vest 10 allow for mounting of additional containers without the use of the shoulder straps 27 (FIG. 2).

Once the containers 28 and 58 are correctly positioned and fully secured on the vest 10, the vest 10 is then positioned on the torso or upper body of the user 100. Preferably, the vest 10 is of such a length as to extend beyond the waist of the user 100 a short distance. The user 100 is then ready to move to the patient 102. Once at the patient 102, the user 100 disconnects the containers 28 and 58 from the mounting pad 26 on the back 14 of the vest 10 and flips the containers 28 and 58 over the shoulder 16 of the vest 10 and resecures the containers 28 and 58 on the mounting pads 22 or 24 on the front 12 of the vest 10. This step is unnecessary if the containers 28 and 58 are initially secured on the front 12 of the vest 10. Once the containers 28 and 58 are in position, the user 100 then evaluates the needs of the patient 102. If the patient 102 requires an IV, then the user 100 opens the IV container 28. The container 28 is preferably opened by grasping the head of the zipper 35 and holding the bottom of the container 28 on one side and pulling the zipper 35 upward toward the shoulders 16 of the vest 10. Preferably, the zipper 35 does not need to be completely unzipped. Once the zipper 35 is partially unzipped, the right and left portions 30 and 32 of the container 28 are grasped and folded backwards so as to expose the inside of the container 28. The right and left portions 30 and 32 are preferably folded back behind the center portion 34 of the container 28 (FIG. 3). In the preferred embodiment, when the right and left portions 30 and 32 of the container 28 are folded back, the left and right sections 34A and 34C of the center portion 34 of the container 28 also fold back. The folding back of the left and right sections 34A and 34C of the center portion 34 is a result of the rigid middle section 34B of the center portion 34 which will not easily fold or bend. The ability of the IV container 28 to remain in the "open" position allows the user 100 to use both hands to remove the necessary medical supplies from the IV container 28 and to connect the IV to the patient 102.

In the preferred embodiment, the IV container 28 includes all the medical supplies necessary to start an IV. Once the IV has been connected to the patient 102, the container 28 is then zipped to the semi-closed position so that there remains an opening in the zipper closure which allows the IV line 152 to extend from the IV bag 150 through the opening in the container 28 and to the patient 102 (FIG. 6). Preferably, the clip 44 at the bottom of the container 28 secures the drip chamber 160 so that only the IV line 152 extends from the bag 150. If necessary, the patient 102 is then treated using medical supplies from the medical supply container 58. To use the medical supply container 58, the container 58 is first removed from the vest 10. To remove the container 58, preferably the container 58 is first unsecured from the mounting pads 22, 24 or 26 and then is unclipped from the shoulder strap 27. Next, the container 58 is opened by unclipping the closure fastener 68 and the fastener 60 on the flap 58D. Once the patient 102 has been fully tended and is ready for transport, the user 100 removes the IV container 28 from the vest 10. The IV container 28 is removed similarly to removing the medical supply container 58. Next, the clip strap 46 is fastened by the fastener 49 to the fastener 50 on the top of the container 58. The self-closing hook 48 is then attached adjacent to the patient 102 so that the IV container 28 is transported with the patient 102.

It is intended that the foregoing description be only illustrative of the present invention and that the present invention be limited only by the hereinafter appended claims.

I claim:

1. A container for mounting on an article of clothing for wearing on an upper body of a user for holding emergency medical supplies, the article of clothing including a front section and a back section, the container which comprises:

(a) a first, second and third section, each section having a top and a bottom with a first and second side extending therebetween forming an inside surface and an outside surface, the sections are connected together so that the first side of the second section is connected to the second side of the first section, and the first side of the third section is connected to the second side of the second section so that the top of the sections are adjacent, wherein the container is removably mounted on the article of clothing so that the outside surface of the second section of the container is adjacent the front section of the article of clothing and wherein the medical supplies are removably mounted on the inside surface of the second section of the container;

(b) a fastener having a first half and an opposite and engaging second half, each half having a first end and a second end with the first end of the first half mounted on the top of the first section and the second end of the first half mounted on the bottom of the first section so that the first half of the fastener extends along the first side of the first section and with the first end of the second half of the fastener mounted on the top of the third section and the second end of the second half mounted on the bottom of the third section so that the second half of the fastener extends along the second side of the third section wherein when the first half and the second half of the fastener are connected together, the inside surfaces of the first, second and third sections are inside the container, and wherein when the first and second halves of the fastener are unfastened, the first and second sections are configured to be turned so that the inside surfaces of the first, second and third sections are visible.

2. The container of claim 1 wherein an intravenous bag having an opening with an intravenous drip chamber connected to the opening is mounted adjacent the inside surface of the second section of the container so that the opening of the bag and the drip chamber are adjacent the bottom of the second section.

3. The container of claim 2 wherein a line is connected to the intravenous drip chamber and wherein a clip is mounted on the inside surface of the second section adjacent the bottom to securably hold the intravenous drip chamber and the line which extend from the opening of the intravenous bag.

4. The container of claim 1 wherein a pocket is provided on the inside surface of at least one of the sections of the container for holding medical supplies.

5. The container of claim 1 wherein a portion of the second section is rigid to allow the container to remain in an open position.

6. The container of claim 1 wherein the sections are constructed of a flexible fabric to allow at least the first and third sections to be folded to place the container in open and closed positions.

* * * * *